US006308445B1

(12) United States Patent
Porraro

(10) Patent No.: US 6,308,445 B1
(45) Date of Patent: Oct. 30, 2001

(54) REUSABLE WINDOW MESSAGE MEDIUM

(76) Inventor: Richard Porraro, 4102 Iliad Ct. Bldg. K14, Tampa, FL (US) 33613

( * ) Notice: Subject to any disclaimer, the term of this patent is extended or adjusted under 35 U.S.C. 154(b) by 0 days.

(21) Appl. No.: 09/477,814

(22) Filed: Jan. 5, 2000

Related U.S. Application Data

(63) Continuation of application No. 09/158,132, filed on Sep. 21, 1998, now abandoned, which is a continuation of application No. 08/771,500, filed on Dec. 23, 1996, now abandoned.

(51) Int. Cl.[7] ..... G09F 7/12
(52) U.S. Cl. ..... 40/594; 283/81; 434/408
(58) Field of Search ..... 40/593, 594, 638; 428/47.7, 42.1; 283/81; 434/408, 415, 416, 417, 425

(56) References Cited

U.S. PATENT DOCUMENTS

| | | | |
|---|---|---|---|
| 2,603,899 | 7/1952 | Leander | 40/594 |
| 3,508,356 | 4/1970 | Ross | 40/593 |
| 5,102,171 | 4/1992 | Saetre | 283/117 |
| 5,334,431 | 8/1994 | Longtin | 428/40 |
| 5,352,535 | 10/1994 | Su | 40/593 X |
| 5,430,965 * | 7/1995 | Lai | 40/593 X |
| 5,527,568 | 6/1996 | Boone et al. | 428/14 |

FOREIGN PATENT DOCUMENTS

| | | | |
|---|---|---|---|
| 2367623 | 10/1976 | (FR) | 434/425 |

* cited by examiner

*Primary Examiner*—Brian K. Green
(74) *Attorney, Agent, or Firm*—Saliwanchik, Lloyd & Saliwanchik

(57) ABSTRACT

Disclosed is a message display device for use on glass, high polish surfaces, and other smooth, non-porous surfaces. In a preferred embodiment, it is approximately the size of a bumper sticker and adheres to car windows by a border of static cling vinyl. Messages and graphics are written or drawn on a colored and scaled area with a special delible pen. The device may be removed and repositioned frequently and messages may be erased and rewritten repeatedly.

5 Claims, 1 Drawing Sheet

REUSABLE WINDOW MESSAGE MEDIUM

CROSS-REFERENCE TO A RELATED APPLICATION

This application is a continuation of application Ser. No. 09/158,132, filed Sep. 21, 1998, now abandond, which is a continuation of application Ser. No. 08/771,500, filed Dec. 23, 1996, now abandoned.

BACKGROUND OF THE INVENTION

Cars and other vehicles are commonly used as media by which drivers convey messages to neighboring motorists, pedestrians, and others. One frequently used communication method comprises writing messages on windows with shaving cream, shoe polish, wax, or other materials. Another method is the use of bumper stickers, which offer a variety of sayings and graphics, and are readily available, inexpensive, and permanent. However, the consumer is often limited to displaying stickers that are ready-made as opposed to custom-made. This problem is solved to some extent by print shops and other manufacturers that print custom-designed bumper stickers, as for political campaigns. However, the permanent nature of these bumper stickers creates a problem when users want to change the messages displayed on their bumpers. One solution is to cover outdated bumper stickers with other stickers. Another option is to remove the stickers, which often leave a sticky residue or damage the car's finish.

Certain decal manufacturers solve this problem by printing messages and graphics on static cling vinyl, which electrostatically adheres to glass and other smooth, non-porous surfaces and is easily removed without causing damage to the glass surface or leaving an adhesive residue. However, a drawback to these decals, as with conventional bumper stickers, is that the consumer is limited to displaying ready-made designs, instead of having the ability to pen his or her own individual, unique message.

The subject invention aims to solve the problems associated with conventional bumper stickers and static cling decals by offering an alternative which is an inexpensive and non-damaging, medium by which people may display their own messages, which are easily erased and can be repeatedly updated.

BRIEF SUMMARY OF THE INVENTION

The subject invention pertains to a message display device for use on glass, plastic, high polish surfaces, and other smooth, non-porous surfaces. In a preferred embodiment, the display device of the subject invention is approximately the size of a bumper sticker and adheres to car windows by a border of static cling vinyl. Messages and graphics are written or drawn on a sealed area with a special delible pen. Preferably the sealed area is colored to provide contrast to glance the visibility of the message. In a preferred embodiment, the message display device is viewed through a transparent material to which it is affixed. In a special embodiment, a border of static cling material attaches the device to glass or other transparent surface so that the message can be seen through the transparent surface. The device may be removed and repositioned frequently and messages may be erased and rewritten repeatedly.

DETAILED DESCRIPTION OF THE INVENTION

In a preferred embodiment the subject invention pertains to a message display device for placement on the interior of a structure or vehicle window to convey a custom-written message or graphic through the window. The message display device of the subject invention removably adheres to glass or plastic or other high polish surfaces by means of a border of static cling vinyl. In a preferred embodiment, messages are written with a special delible pen and may be erased and changed repeatedly.

Figure 1:
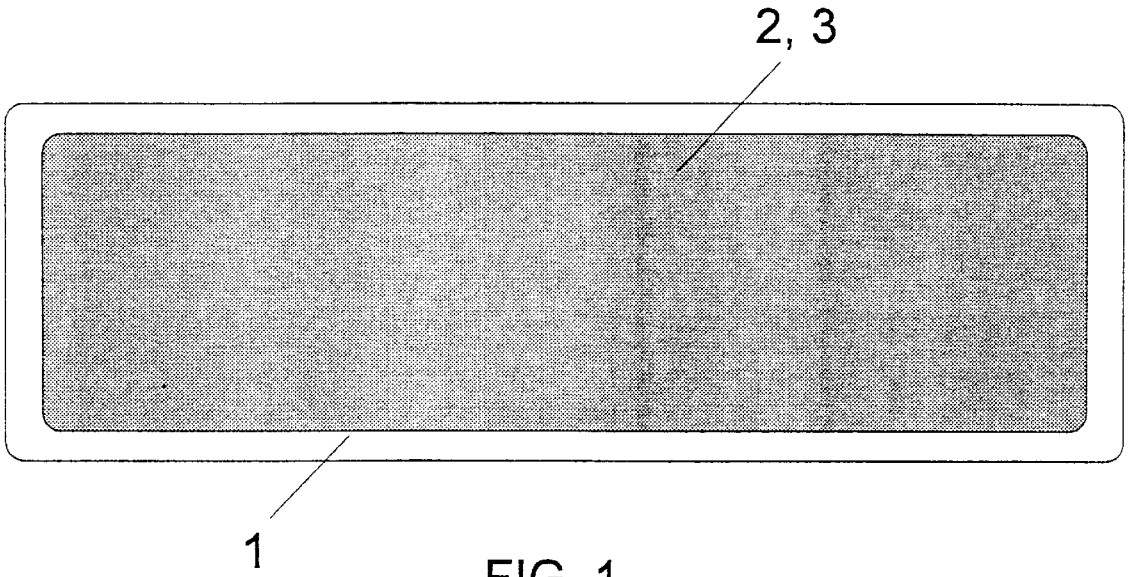
FIG. 1 illustrates a plane view of a specific embodiment of the subject invention.
Figure 2:
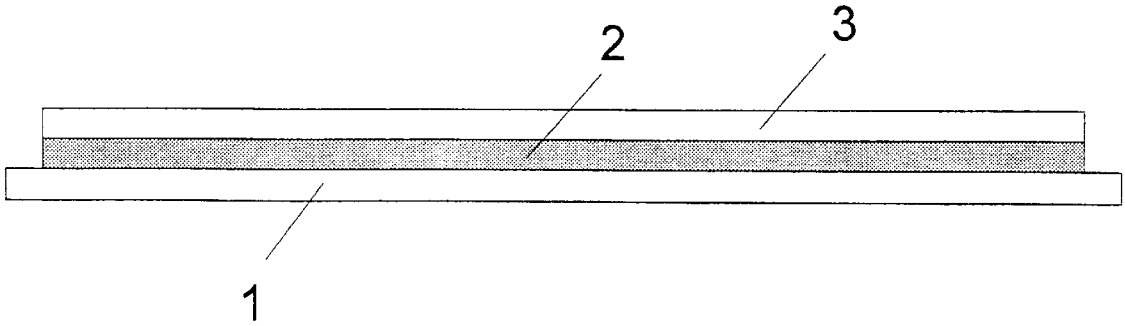
FIG. 2 illustrates a profile view of a specific embodiment of the subject invention.

As shown in FIGS. 1 and 2, the subject invention comprises a backing of static-cling vinyl, 1, which is typically transparent and clings to glass, high polish surfaces, and other smooth, non-porous surfaces without adhesives. Alternatively,the static cling material can be colored. The static cling portion may be applied and removed repeatedly from the surface(s) to which it is affixed. Upon the static cling backing, at least one layer of coloring, 2, may be deposited, leaving an uncolored border of static-cling vinyl. The colored portion may be, for example, paint, ink, or dye. This colored area is then covered with a varnish, ultraviolet coating, or other sealant, 3. This covered, colored area, 2, 3, is where messages can be written, erased, and rewritten. If the static cling material is, itself, colored, then it is not necessary to add a colored layer. Instead, the sealant can be applied directly to a portion of the colored static cling material, thus creating the area where messages can be written.

In a preferred embodiment of the subject invention, when the display device is used, messages are written on the colored area with a delible pen which contains ink that is easily releasable (i.e., erasable) from the sealed surface of the invention, either by dry or wet wiping. Typically, the ink of this pen will be an alcohol or water based ink. The pen may be, for example, a "dry erase" pen.

The message can be displayed by placing the display device of the subject invention on the inside surface of a window, preferably that of a car or other vehicle. The sealed, colored area does not stick to the window; however, the invention affixes firmly, yet removably, to the window by an exposed unsealed border of static-cling vinyl.

The display device of the subject invention may be produced in any size, permitting use in structure windows, as well as car windows. For example, the display devices of the subject invention may be used for conveying temporary messages, such as sale specials in store windows, which may be changed as needed. Additionally, the display devices may be produced using various background colors and design patterns. Various ink or background colors may be used for pictures or eye-catching messages.

In a specific embodiment, the invention can be used on the inside surface of a window to prevent theft and defacement of the device and/or message. However, because static-cling vinyl may comprise the entire back surface of the invention, it may be also attached to the outside surface of windows, as in the case of tinted windows which may hinder message visibility.

The following example illustrates a specific embodiment of the subject invention. This example should not be construed as limiting.

EXAMPLE 1

In a specific embodiment of the subject invention, one or more layers of paint or other coloring material are deposited on an approximately 4 inch by 10 inch backing of static-cling vinyl, leaving an exposed, uncolored border of static-cling vinyl that is about ½ inch wide, as shown in FIGS. 1 & 2. The coloring may be, for example, Flexo ink. The coloring is used for message visibility, background, and design purposes. Then, a layer of UV varnish or other sealant, is deposited over the coloring.

A pen containing, for example, dry erase ink, can be used to write messages or draw designs on the colored and sealed surface of the invention.

The invention, with its custom message or graphic, can then be affixed to glass for display. The invention may be easily removed and replaced on the glass, and the ink can readily be wiped off and the message changed.

It should be understood that the example and embodiments described herein are for illustrative purposes only and that various modifications or changes in light thereof will be suggested to persons skilled in the art and are to be included within the spirit and purview of this application and the scope of the appended claims.

What is claimed is:

1. A method of displaying messages comprising:

a) writing a message on a message displaying device with an erasable writing instrument, wherein said message displaying device comprises at least two layers, a backing layer and a surface layer, wherein;

i) said backing layer comprising a front side and a back side, and said backing layer being a static-cling vinyl, whereby said front side and said back side of said backing layer can be repeatedly removably attached to a smooth non-porous surface, ii) said surface layer comprising a message surface centrally located on said front side of said backing layer, said message surface being surrounded by a border of said static-cling vinyl, said message surface comprising a material which can be erasably written on, wherein, said message is written on said message surface;

b) removably affixing said message displaying device to a smooth non-porous surface, wherein said message display device is affixed to said smooth nonporous surface by placing said static-cling vinyl in contact with said smooth non-porous surface, such that said border of said static-cling vinyl, which includes a portion of the front side of the backing layer, removably engages said smooth non-porous surface;

c) displaying said message for a period of time;

d) removing said message displaying device from said smooth non-porous surface, whereby said message display device is removed from said smooth non-porous surface by peeling said static-cling vinyl away from said smooth non-porous surface;

e) erasing said written message from said message displaying device:

f) repeating steps a through e for a new message.

2. A method for displaying a message according to claim 1, wherein said smooth non-porous surface is a glass surface.

3. A method for displaying a message according to claim 2, wherein said front side of a message display device is removably affixed to said glass surface, whereby said written message is display through said glass surface in the proper orientation.

4. A method for displaying a message according to claim 1, wherein said smooth non-porous surface is a transparent plastic surface.

5. A method for displaying a message according to claim 4, wherein said front side of a message display device is removably affixed to said transparent plastic surface, whereby said written message is displayed through said plastic surface in the proper orientation.

* * * * *

UNITED STATES PATENT AND TRADEMARK OFFICE

CERTIFICATE OF CORRECTION

PATENT NO. : 6,308,445 B1
DATED : October 30, 2001
INVENTOR(S) : Richard Porraro It is certified that error appears in the above-identified patent and that said Letters Patent is hereby corrected as shown below:

Title page,
ABSTRACT, line 6, "scaled" should read -- sealed --.

Column 1,
Line 55, "glance" should read -- enhance --.

Column 4,
Line 5, "nonporous" should read -- non-porous --.
Line 27, "display" should read -- displayed --.

Signed and Sealed this

Twenty-eighth Day of May, 2002

*Attest:*

*Attesting Officer*

JAMES E. ROGAN
*Director of the United States Patent and Trademark Office*